US007730864B2

(12) United States Patent
Toedter et al.

(10) Patent No.: US 7,730,864 B2
(45) Date of Patent: Jun. 8, 2010

(54) METHOD OF OPERATING GLOW PLUGS IN DIESEL ENGINES

(76) Inventors: Olaf Toedter, Römerstrasse 13, Walzbachtal (DE) D-75045; Markus Kernwein, Über der Höhe 2, Bretten-Büchig (DE) D-75015; Andreas Bleil, Einsteinstrasse 9, Ludwigsburg (DE) D-71636; Jörg Stöckle, Hauptstrasse 125, Ludwigsburg (DE) D-71642; Franz Pachner, Schlüsselhofgasse 30, Steyr (AT) A-440

( * ) Notice: Subject to any disclaimer, the term of this patent is extended or adjusted under 35 U.S.C. 154(b) by 292 days.

(21) Appl. No.: 11/796,285

(22) Filed: Apr. 27, 2007

(65) Prior Publication Data

US 2008/0163840 A1 Jul. 10, 2008

(30) Foreign Application Priority Data

May 5, 2006 (DE) ..... 10 2006 021 285

(51) Int. Cl.
*F23Q 7/00* (2006.01)

(52) U.S. Cl. ..... 123/145 A

(58) Field of Classification Search ..... 123/145 R, 123/145 A, 405.55; 219/270
See application file for complete search history.

(56) References Cited

U.S. PATENT DOCUMENTS

| | | | | |
|---|---|---|---|---|
| 4,658,772 | A | 4/1987 | Auth et al. | |
| 5,329,901 | A | 7/1994 | Onishi | |
| 6,843,218 | B2 * | 1/2005 | Kumada et al. | 123/179.6 |
| 6,906,288 | B2 * | 6/2005 | Toedter et al. | 219/270 |
| 7,002,106 | B2 * | 2/2006 | Toedter et al. | 219/270 |
| 7,319,208 | B2 * | 1/2008 | Gotoh et al. | 219/270 |
| 7,431,004 | B2 * | 10/2008 | Kernwein et al. | 123/145 A |
| 7,487,753 | B2 * | 2/2009 | Gotou et al. | 123/145 A |
| 2004/0118828 | A1 | 6/2004 | Toedter | |
| 2004/0255889 | A1 | 12/2004 | Kumada | |
| 2005/0039732 | A1 | 2/2005 | Toedter et al. | |
| 2005/0081812 | A1 * | 4/2005 | Toedter et al. | 123/145 A |
| 2006/0207541 | A1 * | 9/2006 | Hiramatsu | 123/145 A |
| 2006/0289425 | A1 | 12/2006 | Serra | |

(Continued)

FOREIGN PATENT DOCUMENTS

EP 3729638 B1 7/1988

(Continued)

OTHER PUBLICATIONS

"Das elektronisch gesteuerte Glühsystem ISS für Dieselmortoren," DE-Z MTZ Motortechnische Zeitschrift, 2000, 668-675, 610.

*Primary Examiner*—Hai H Huynh

(57) ABSTRACT

The invention describes a method for operating glow plugs, that comprise a housing and a heater element projecting beyond that housing, in a diesel engine which interacts with an engine control unit and a glow plug control unit which latter, following a preheating phase, controls the electric power supplied to the glow plugs in response to an input received from the engine control unit. It is provided according to the invention that the engine control unit determines a value representative of a temperature that is to be reached at the heater element and the engine control unit transmits that value as target value to the glow plug control unit which implements that target value using an algorithm stored in the glow plug control unit and with reference to characteristic values stored in the glow plug control unit.

18 Claims, 1 Drawing Sheet

U.S. PATENT DOCUMENTS

Figure 1:
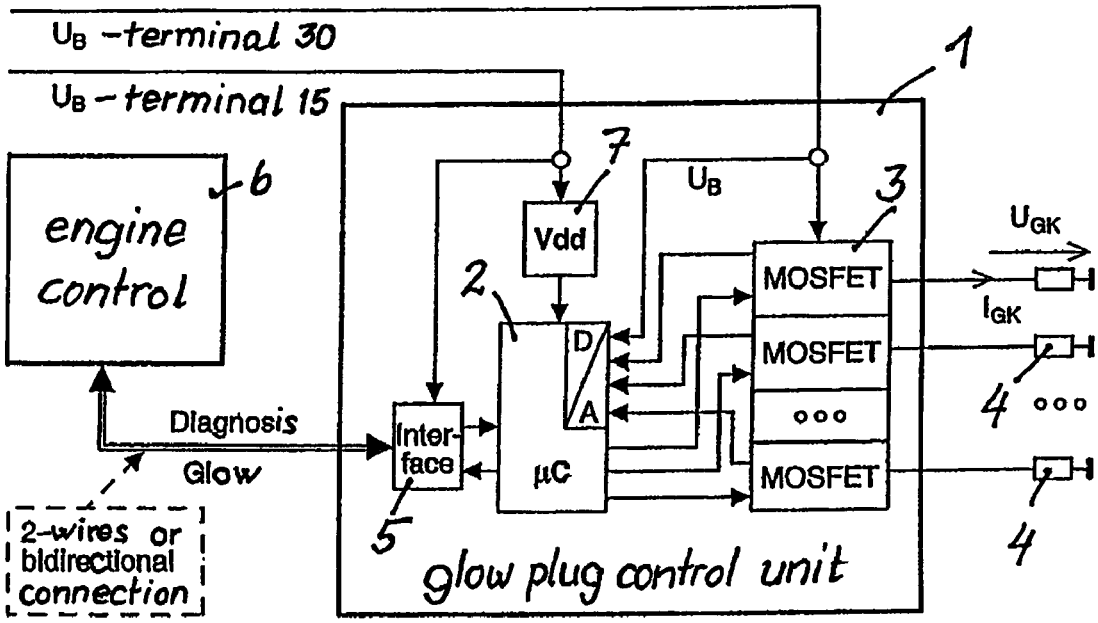

| | | | | |
|---|---|---|---|---|
| 2008/0210186 | A1 * | 9/2008 | Stoller | 123/145 A |
| 2008/0319631 | A1 * | 12/2008 | Kernwein et al. | 701/102 |
| 2009/0012695 | A1 * | 1/2009 | Kernwein et al. | 701/102 |

FOREIGN PATENT DOCUMENTS

| | | | |
|---|---|---|---|
| JP | 59108878 | A | 6/1984 |
| JP | 04350368 | A | 12/1992 |
| JP | 2004 346756 | A | 12/2004 |
| JP | 2009-13979 | * | 1/2009 |

* cited by examiner

METHOD OF OPERATING GLOW PLUGS IN DIESEL ENGINES

The present invention relates to a method having the features defined in the preamble of claim 1. A method of this kind has been known from the paper entitled "Das elektronisch gesteuerte Glühsystem ISS für Dieselmotoren", published in DE-Z MTZ Motortechnische Zeitschrift 61, (2000) 10, pp. 668-675.

FIG. 1 shows a block diagram of a glow plug control unit 1 intended for carrying out the known method. That control unit comprises a microprocessor 2 with integrated digital-to-analog converter, a number of MOSFET power semiconductors 3 for switching on and off an identical number of glow plugs 4, an electric interface 5 for establishing connection with an engine control unit 6 and an internal voltage supply 7 for the microprocessor 2 and the interface 5. The internal power supply 7 is connected with the vehicle battery via "terminal 15" of the vehicle.

The microprocessor 2 controls the power semiconductors 3, reads their status information and communicates with the engine control unit 6 via the electric interface 5. The signals required for communication between the engine control unit 6 and the microprocessor 2 are conditioned by the interface 5. The voltage supply 7 supplies a steady voltage for the microprocessor 2 and the interface 5.

Glow plugs serve the function to ensure safe ignition of the fuel-air mixture when the diesel engine is started in cold condition, and thereafter to procure smooth running of the diesel engine in an after-glow phase until the engine is hot enough to guarantee steady smooth running even without the support of glow plugs. The after-glow phase takes up to a few minutes. During the after-glow phase the glow plug is to assume a constant temperature, the steady-state temperature, for which approximately 1000° Celsius is a typical value. For maintaining the steady-state temperature, modern glow plugs do not require the full voltage provided by the electric system of the vehicle, but rather a voltage of typically 5 Volts to 6 Volts. The power semiconductors 3 are controlled for this purpose by the microprocessor 2 by a pulse-width modulation method with the result that the voltage provided by the vehicle system, which is supplied to the power semiconductor 3 via "terminal 30" of the vehicle, is modulated so that the desired voltage is applied to the glow plugs in time average.

When the diesel engine is started in cold condition, then the control unit 1 supplies the glow plugs 4 with a higher heating-up voltage of, for example, 11 Volts so that the glow plugs will reach a temperature equal to the steady-state temperature, or—preferably—a temperature some 10° above that temperature, as quickly as possible. According to the teachings of MTZ 61 (2000) 10, pp. 668-675, rapid heating-up of the glow plugs is energy-controlled in the pre-heating phase, which means that the respective glow plug is supplied with an energy suitably predetermined to ensure that the steady-state temperature will be reached in any case. Preferably, the steady-state temperature is initially exceeded to then drop to the steady-state temperature.

Following a cold start, the engine will for some time operate in what is known as the cold-running phase, which is characterized by an idling speed above the idling speed of the engine at operating temperature. During the cold-running phase the effective voltage applied to the glow plugs, i.e. the voltage applied in time average as a result of the pulse-width modulation, is lowered by steps from the initial heating-up voltage of, for example, 11 Volts (the "initial value") to a voltage of, for example, 6 Volts (the "target value" of the voltage) at which the steady-state temperature of the glow plugs of 1000° Celsius, for example, can be maintained. Any variations of the voltage of the on-board system can be balanced out in a controlled way by varying the on-time.

According to the prior art, the voltage applied to the glow plugs 4 in time average is lowered by steps in the cold-running phase during a period of time that is predefined based on empirical values stored in the microprocessor 2. The period of time during which the effective voltage is increased in the cold-running phase is maximally as long as the cold-running phase as such, preferably shorter than the latter.

The glow plugs are cooled down to different degrees depending on the engine speed and the engine load or the engine torque. In order to still keep the glow plug temperature constant, with the engine at operating temperature, after the cold-running phase, but before the normal operating temperature of the engine is reached, the electric power applied to the glow plugs is adjusted to the varying conditions. This is done according to signals received from the engine control unit 6 by increasing or lowering the target value of the voltage applied to the glow plugs 4 in time average.

According to the prior art, it is the engine control unit that decides, on the basis of evaluations made by itself, at what times glow plug operation is to be initiated and for what periods of time it is to continue. The engine control unit is provided for this purpose with an intelligence which is exercised with the aid of a state machine integrated in the engine control unit. The state machine operates on the basis of a rigid, firmly predefined scheme and produces instruction signals that are transmitted to the glow plug control unit normally provided on the engine block, which then implements the input received from the engine control unit for the purpose of controlling the electric power supplied to the glow plugs, with reference to the glow plug model stored in the glow plug control unit. This requires that the two control units and the algorithms performed by them, to the extent they are related to the control of the glow plugs, be adapted one to the other.

Now, it is the object of the present invention to reduce the expense of realizing the control of glow plugs.

The invention achieves this object by a method having the features defined in Claim 1. Advantageous further developments of the invention are the subject-matter of the subclaims.

The method according to the invention of operating glow plugs, that comprise a housing and a heater element projecting beyond that housing, in a diesel engine which interacts with an engine control unit and with a glow plug control unit which latter, following a preheating phase, controls the electric power supplied to the glow plugs in response to an input received from the engine control unit, is characterized in that the engine control unit determines a value representative of a temperature that is to be reached at the heater element. That value is transmitted by the engine control unit as target value to the glow plug control unit which implements that target value using an algorithm stored in the glow plug control unit and with consideration to characteristic values likewise stored in the glow plug control unit.

This provides essential advantages:

The glow plug control unit contains a target value, i.e. a temperature value that is to be reached at the heater element, or a value representative of that temperature, the latter being the really important functional value under aspects of engine operation because it is the temperature of the heater element, especially its surface temperature, which is the decisive factor which ensures that the fuel-air mixture can be satisfactorily ignited during the starting and the cold running phases of the diesel engine, and which further may have a decisive influence on emission and engine running characteristics at additional operating points of the engine.

The minimum requirements regarding the temperature of the heating element of the glow plugs, for ensuring ignition of the fuel-air mixture, depend on the type of engine, its operating state and on the way the vehicle is driven, whereas dependence on the type of glow plug used can be neglected. Optimally, the temperature that is to be reached at the heater element of the glow plugs should be determined in the engine control unit.

The behavior of glow plugs in diesel engines depends on the type of glow plug used. Optimally, the characteristics and boundary conditions under which the heater element of glow plugs assumes a temperature defined as target value, should be taken into consideration exclusively in the glow plug control unit because in this case the glow plug control unit will need a single target value only, namely the temperature that is to occur at the heater element, or a value representative of that temperature.

The glow plug control unit can function independently based on that target value. Conversely, the engine control unit can operate without particular regard to the concrete operation of the glow plug control unit, as long as the latter supplies a target value for the temperature that can be processed by the glow plug control unit.

Consequently, the engine control unit on the one hand and the glow plug control unit on the other hand can be realized substantially independently one from the other as regards their structure and function. Mutual limitations with respect to the function of the two control units are minimized, which means that a maximum of degrees of freedom is left for the configuration of the two control units and their respective operation. Especially, the developer of the engine control unit is no longer restricted by a state machine that operates on the basis of a rigid scheme adapted to the glow plug control unit.

The manufacturer of the glow plugs, being predestined to produce the control unit for the glow plugs provided by him and to define its function, can do that without particular regard to the engine control unit.

As the temperature that is to be encountered at the heater element of the glow plugs is defined by the engine control unit, there is no dependence between the control of the glow plugs and any state of the engine control or any transition in state of the engine control. The glow plug control unit can react to any input of the engine control unit autonomously.

According to the prior art, the glow plugs are controlled, following a pre-heating phase, so that the temperature encountered at the heater element remains at the predetermined value, if possible; that temperature is therefore described as the steady-state temperature. According to an advantageous further development of the invention, the target value supplied by the engine control unit as value for the temperature that is to occur at the heater element is, however, variable in the running state of the diesel engine. This leads to a number of further advantages:

The temperature of the glow plugs can be optimized by adapting it to the operating state of the diesel engine.

The glow plug can be used not only during the starting phase and for a time of a few minutes thereafter, but may be used to support combustion even over a longer period of time.

The use of glow plugs as combustion support permits the emissions of diesel engines to be reduced.

Extending the operating time of glow plugs presents a special advantage with respect to the efforts on the part of manufacturers of diesel engines to reduce compression of the diesel engine with a view to reducing its emission of hydrogen oxides. However, as compression is reduced, the cold-running behavior of the diesel engine deteriorates and the ignition temperature of the fuel-air mixture increases. Those disadvantages can be remedied by the further development of the invention.

The temperature occurring at the heater element of the glow plugs can be reduced as heating-up of the engine progresses. That leads to an extended service life of the glow plugs.

During the coasting phase of the diesel engine, the glow plugs can be operated with greatly reduced heating power to enhance combustion, which increases the service life of the glow plugs.

With rising engine load, especially under full load, the temperature of the heater element of the glow plugs may be increased temporarily, for enhancing combustion and reducing emissions and also for improving smooth running of the engine when the engine is still below its operating temperature.

Vehicles equipped with a particle filter in the exhaust-gas line of the diesel engine require reconditioning of such filters from time to time, for example by temporarily increasing the exhaust-gas temperature so as to burn any particles adhering to the filter. The temperature increase can be achieved, for example, by after injecting diesel fuel into the cylinders during the expansion phase. When the heater element is operated at low temperature during that phase, this will further the temperature increase at the particle filter. A fact to be especially underlined is the possibility to lower the temperature of the glow plugs when the relatively high steady-state temperature of steel glow plugs of for example 1000° Celsius, as used in the prior art, is not needed. The resulting lower load on the glow plug can be used either to drastically extend the service life of the glow plug or to use it as combustion support over extended periods without any loss in service life.

The engine control unit determines the target value for the temperature at the heater element of the glow plug advantageously as a function of the operating state of the diesel engine. In determining the target value for the temperature, it is possible to consider not only the current operating state of the diesel engine but also the previous development of the operating state of the diesel engine which can be observed by the engine control unit using associated sensors. That provides the possibility to react more quickly to variations in operating state of the diesel engine, which may even be predicted for a certain period of time, based on the observed previous development.

The efficiency of a glow plug depends primarily on the surface temperature of the heater element of the glow plugs. The surface temperature therefore is the primary factor in determining the target value to be determined by the engine control unit.

The surface temperature of the heater element of the glow plugs cannot be measured directly in the diesel engine.

There is, however, the possibility to generate a model of the behavior of a given type of glow plugs in a given diesel engine, based on empirical values gained on an engine test-bed, and to then store that model in the glow plug control unit in the form of characteristic lines and/or characteristics fields and to drive the glow plugs according to the characteristic lines and the characteristics fields so stored so that they will be supplied with a given effective voltage at given times for reaching the target temperature or a value sufficiently close to it. In selecting the effective voltage and the duration for which the glow plugs will be supplied with the selected effective voltage the glow plug control unit will account for characteristics and boundary conditions stored in the glow plug control unit. The characteristics and boundary conditions which may be stored in the glow plug control unit, and one or more of which can be accounted for, include the type of engine, the type of glow plug, the electric resistance of the glow plugs at a reference temperature, the temperature dependence of the electric resistance of the glow plugs, the thermal capacity of the glow plugs, the cooling-down behavior of the glow plugs as a function of engine speed, the coolant temperature and the sign of a speed change of the engine, further the heat supply from combustion under one or more selected load conditions of the engine. Advantageously, any limit and threshold values that restrict the glow plug control unit in implementing the target value supplied by the engine control unit may also be accounted for; for example, it can be ensured that a target value for the temperature of the heater element, transmitted by, the engine control unit, that would overload the glow plugs used, will be limited to a value that is still acceptable to the glow plugs employed. According to an advantageous further development of the invention, the target value for the temperature of the heater element, supplied by the engine control unit, can therefore be interpreted by the glow plug control unit and adapted to the type of glow plug used, after the latter has been determined by the glow plug control unit itself, or has been entered into the glow plug control unit. That adaptation may consist in increasing or reducing the temperature target value and in varying the temperature curve leading to that target value, which might be determined on the basis of a model characteristic line of a glow plug, stored in the glow plug control unit, by suitably varying the model characteristics. The glow plug control unit then determines the energy that is to be supplied to the glow plugs, and then the latter are controlled correspondingly. Likewise, the coolant temperature may be used for deriving a limit value, for example by leaving out of regard the target value provided by the engine control unit for an increased glow plug temperature in order to spare the glow plugs, if and so long as the coolant temperature exceeds a given limit value.

In supplementation of the target value for the temperature of the heater element of the glow plugs, the glow plug control unit may, in implementing the target value, consider with advantage additional parameters supplied to it from the outside, preferably from the engine control unit, such as the rate of fuel injection per cycle, the coolant temperature, the speed of the diesel engine, the sign of any variation in speed of the diesel engine and the temperature of the combustion air flowing into the cylinders of the diesel engine.

Further, the glow plug control unit may account for the temperature maximally possible, for example when steel glow plugs are used. It may limit or interpret the predefined temperature based on the type of glow plug as entered into the system or determined by the glow plug control unit.

Preferably, for determining the target value of the temperature of the heater element by the engine control unit, one initially defines the basic temperature for the post-heating time and then specifies a lower temperature, compared with the basic temperature, as a target for one or more of the following cases: The diesel engine is coasting (in that case, the fuel supply may be switched off); the coolant temperature exceeds a given threshold value (the higher the coolant temperature, the sooner one can do without combustion support by a hot glow plug); the temperature of the combustion air flowing into the cylinders exceeds a given threshold value (any increase of the temperature of the combustion air increases the ignitability of the mixture and permits the glow plug temperature to be reduced); the voltage of the electric power source (voltage of the on-board system) is below a given threshold value (power consumption from the on-board system is limited as a precautionary measure in case capacity should be low).

A temperature higher than the temperature specified before by the engine control unit can be specified by the engine control unit for example in cases where one or more of the following conditions are fulfilled: The pollutants content in the exhaust gas of the diesel engine exceeds one or more limit values (in that case increasing the temperature of the glow plugs may enhance combustion); a coasting phase of the diesel engine is terminated (the glow plug, having cooled down during the coasting phase, is heated up again for the next following load event); the coolant temperature is below a threshold value which condition occurs in longer stop-and-go phases (increasing the temperature of the glow plugs enhances combustion and reduces emissions, a point of particular importance in city traffic); the temperature of the combustion air flowing into the cylinder is below a threshold value (increasing the temperature of the glow plugs enhances combustion and reduces emissions); the fuel injection rate, or the load of the diesel engine rises and/or exceeds a threshold value (the increased temperature of the glow plug may have a combustion-enhancing effect, at least temporarily); during heating, as regeneration enhancement for a particle filter present in the exhaust line of the diesel engine.

A matrix of correction values may be stored, for example, in the glow plug control unit for correcting the supply of electric energy to the glow plug specified for standard cases in response to the speed and the momentary fuel consumption (for example in $mm^3$ per stroke). The matrix contains the correction value for discrete pairs of values for speed and consumption. The energy supply to the glow plugs tends to rise as the speed rises and to drop as consumption rises.

The model of the glow plugs and of their behavior in the diesel engine, stored in the glow plug control unit in the form of characteristic values and characteristics fields, makes it possible for the glow plug control unit to implement an open control loop, based on the target value specified for the engine control unit for the temperature of the heater element of the glow plugs.

The invention claimed is:

1. Method of operating glow plugs, that comprise a housing and a heater element projecting beyond that housing, in a diesel engine which interacts with an engine control unit and with a glow plug control unit which latter, following a preheating phase, controls the electric power supplied to the glow plugs in response to an input received from the engine control unit, wherein the engine control unit flexibly determines a value representative of a temperature that is to be reached at the heater element, and that the value so determined is transmitted by the engine control unit as target value to the glow plug control unit which implements that target value using an algorithm stored in the glow plug control unit and with consideration to characteristic values stored in the glow plug control unit.

2. The method as defined in claim 1, wherein the target value is variable in the running state of the diesel engine.

3. The method as defined in claim 2, wherein target value is determined as a function of the operating state of the diesel engine.

4. The method as defined in claim 2, wherein the target value is determined as a function of the previous development of the operating state of the diesel engine.

5. The method as defined in claim 2, wherein the engine control unit predicts the development of the engine state and determines the target value as a function of the predicted development of the engine state.

6. The method as defined in claim 5, wherein the engine control unit predicts the development of the engine state based on the previous development of the engine state.

7. The method as defined in claim 2, wherein one initially defines a basic temperature for the phase that follows the preheating phase (post-heating time) as a target for the heater element of the glow plugs, and then specifies a lower temperature, compared with the basic temperature, as a target for one or more of the following cases: The diesel engine is coasting; the coolant temperature exceeds a threshold value; the temperature of the combustion air flowing into the cylinders exceeds a threshold value; the voltage of the electric power source is below a threshold value.

8. The method as defined in claim 7, wherein a higher temperature than the said lower temperature or than the base temperature is specified as a target if one or more of the following cases occur: The content of pollutants in the exhaust gas of the diesel engine exceeds one or more limit values; a coasting phase of the diesel engine is terminated; the coolant temperature is below a threshold value; the temperature of the combustion air flowing into the cylinders is below a threshold value; the fuel injection rate exceeds a threshold value; the load of the diesel engine rises and/or exceeds a threshold value; the temperature of a particle filter present in the exhaust line of the diesel engine is raised for regeneration purposes.

9. The method as defined in claim 1, wherein the target value is indicative of the surface temperature of the heater element of the glow plugs.

10. The method as defined in claim 1, wherein the decision whether a preheating operation is to be carried out is made in the glow plug control unit.

11. The method as defined in claim 1, wherein a decision is made in the glow plug control unit if the glow operation is to be carried out under the control of timing pulses or continuously.

12. The method as defined in claim 1 wherein the characteristics stored in the glow plug control unit include one or more of the following: The type of engine; the type of glow plug; the electric resistance of the glow plugs at a reference temperature; the temperature dependence of the electric resistance of the glow plugs; the thermal capacity of the glow plugs; the cooling-down behavior of the glow plugs as a function of engine speed; the coolant temperature and the sign of a speed change of the engine; the heat supply from combustion under one or more selected load conditions of the engine; limit values and threshold values that restrict the glow plug control unit in implementing the target value supplied, especially limit values and threshold values of the temperature of the heater element and of the coolant.

13. The method as defined in claim 1, wherein the glow plug control unit takes into account the temperature maximally possible for the given type of glow plug, for example when steel glow plugs are used.

14. The method as defined in claim 1, wherein the glow plug control unit limits or interprets the temperature specified by the glow plug control unit on the basis of information on the type of glow plug determined by the glow plug control unit, or entered into the glow plug control unit.

15. The method as defined in claim 1, wherein in implementing the target value the glow plug control unit takes into account parameters that are supplied to it and that include one or more of the following: The rate of fuel injection per cycle; the coolant temperature; the speed of the diesel engine; the sign of any variation in speed of the diesel engine; the temperature of the combustion air flowing into the cylinders of the diesel engine.

16. The method as defined in claim 15, wherein the parameters are supplied to the glow plug control unit from the engine control unit.

17. The method as defined in claim 1, wherein the value indicative of the temperature that is to occur at the heater element is the only target value which is received by the glow plug control unit from the engine control unit.

18. The method as defined in claim 1, wherein the algorithm includes a decision tree.

* * * * *